US010663118B1

(12) United States Patent
Hsu

(10) Patent No.: US 10,663,118 B1
(45) Date of Patent: May 26, 2020

(54) EXTENDABLE LED LAMP

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/584,974

(22) Filed: Sep. 27, 2019

(51) Int. Cl.

| | |
|---|---|
| ***F21K 9/235*** | (2016.01) |
| ***F21V 21/22*** | (2006.01) |
| ***F21Y 115/10*** | (2016.01) |
| ***F21V 21/005*** | (2006.01) |
| ***F21V 14/02*** | (2006.01) |
| ***F21V 21/30*** | (2006.01) |
| ***F21L 4/04*** | (2006.01) |
| ***F21V 15/01*** | (2006.01) |
| ***F21V 21/34*** | (2006.01) |

(52) U.S. Cl.
CPC ..... *F21K 9/235* (2016.08); *F21V 21/22* (2013.01); *F21L 4/04* (2013.01); *F21L 4/045* (2013.01); *F21V 14/02* (2013.01); *F21V 14/025* (2013.01); *F21V 15/012* (2013.01); *F21V 21/005* (2013.01); *F21V 21/30* (2013.01); *F21V 21/34* (2013.01); *F21Y 2115/10* (2016.08)

(58) Field of Classification Search
CPC ..... F21L 4/04; F21L 4/045; F21V 21/005; F21V 21/22; F21V 21/30; F21V 21/34; F21V 14/02; F21V 14/025; F21V 15/012; F21K 9/235
See application file for complete search history.

(56) References Cited

U.S. PATENT DOCUMENTS

| | | | | |
|---|---|---|---|---|
| 2010/0097804 | A1* | 4/2010 | Wung | F21V 19/0035 362/249.02 |
| 2013/0141914 | A1* | 6/2013 | Lai | F21V 21/22 362/249.03 |
| 2013/0194791 | A1* | 8/2013 | Cercone | F21S 8/046 362/220 |
| 2014/0063803 | A1* | 3/2014 | Yaphe | F21V 15/012 362/247 |
| 2018/0135849 | A1* | 5/2018 | Paseta | F21V 33/004 |
| 2019/0049100 | A1* | 2/2019 | Seligman | F21S 8/046 |
| 2019/0293270 | A1* | 9/2019 | Ansems | F21V 21/22 |
| 2019/0335675 | A1* | 11/2019 | Ngo | A01G 7/045 |

FOREIGN PATENT DOCUMENTS

| | | | | |
|---|---|---|---|---|
| DE | 202012103937 | U1 * | 11/2012 | F21S 8/061 |

* cited by examiner

*Primary Examiner* — Bryon T Gyllstrom
*Assistant Examiner* — Colin J Cattanach
(74) *Attorney, Agent, or Firm* — Alan D. Kamrath; Mayer & Williams PC

(57) ABSTRACT

An LED lamp includes a mounting mechanism, and an illuminating apparatus mounted on the mounting mechanism. The illuminating apparatus includes two first lighting units mounted on the bottom of the mounting mechanism respectively, and a second lighting unit mounted on the bottom of the two first lighting unit. The second lighting unit extends through the two first lighting unit and is connected with the mounting mechanism. Thus, the two first lighting units are slidable on the bottom of the mounting mechanism, such that the LED lamp is extendable to regulate the lighting range according to requirements of the practical environment or situation.

8 Claims, 5 Drawing Sheets

EXTENDABLE LED LAMP

BACKGROUND OF THE INVENTION

1. Field of the Invention

The present invention relates to a lamp and, more particularly, to an LED (light emitting diode) lamp.

2. Description of the Related Art

A conventional LED lamp comprises a support frame, a chip secured to the support frame, a circuit board connected with the chip by an electric wire, and an outer shell mounted on the support frame. The chip is made of material, such as a semiconductor. Thus, the LED lamp provides an illuminating function efficiently. However, the conventional LED lamp has a fixed structure that cannot be extended, such that the LED lamp has a fixed projecting (or lighting) range that cannot be changed or regulated according to requirements of the environment or situation, thereby causing inconvenience to the user when it is necessary to adjust the projecting range of the LED lamp.

BRIEF SUMMARY OF THE INVENTION

The primary objective of the present invention is to provide an LED lamp that is extendable.

In accordance with the present invention, there is provided an LED lamp comprising a mounting mechanism, and an illuminating apparatus mounted on the mounting mechanism. The mounting mechanism includes a wall seat provided with a receiving chamber, and a wall plate mounted on the wall seat and covering the receiving chamber of the wall seat. The receiving chamber of the wall seat has a bottom provided with a slideway and a protruding rib. The illuminating apparatus includes two first lighting units mounted on a bottom of the mounting mechanism respectively, and a second lighting unit mounted on a bottom of the two first lighting unit. The second lighting unit extends through the two first lighting unit and is connected with the mounting mechanism. Each of the two first lighting units includes a first bottom plate, a first cover covering the first bottom plate, a first receiving space defined between the first bottom plate and the first cover, and at least one connecting member mounted in the first receiving space. The first cover is provided with a mounting slot slidably mounted on the protruding rib of the wall seat. Each of the two first lighting units of the illuminating apparatus is connected with the mounting mechanism by engagement between the mounting slot and the protruding rib. The first cover is provided with at least one mounting hole, and the at least one connecting member extends through the at least one mounting hole and is slidably mounted in the slideway of the wall seat.

Thus, the two first lighting units are slidable on the bottom of the mounting mechanism, such that the LED lamp is extendable to regulate the lighting range according to requirements of the practical environment or situation.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 2 is a schematic operational view of the LED lamp as shown in

FIG. 1.

Figure 1:
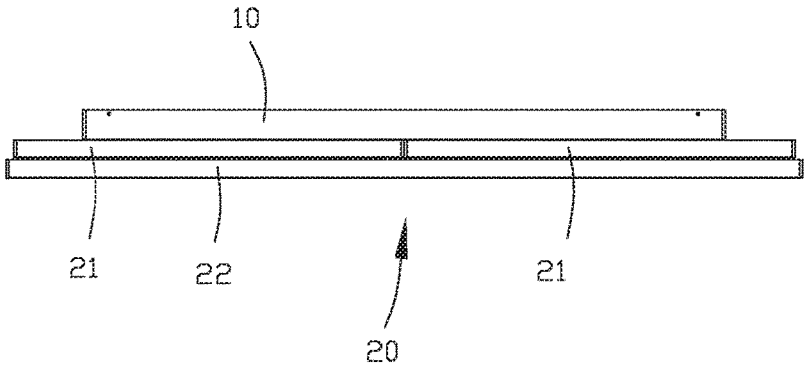
FIG. 1 is a schematic planar structural view of an LED lamp in accordance with the preferred embodiment of the present invention.
Figure 2:
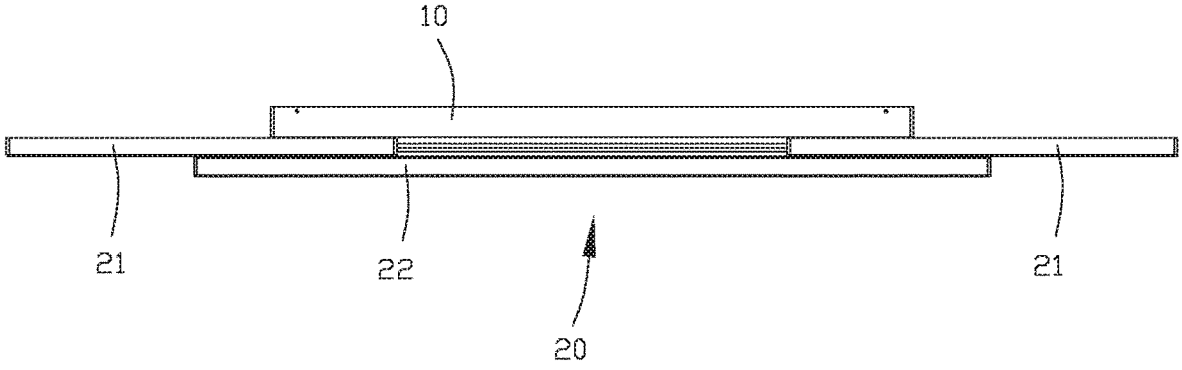
Figure 3:
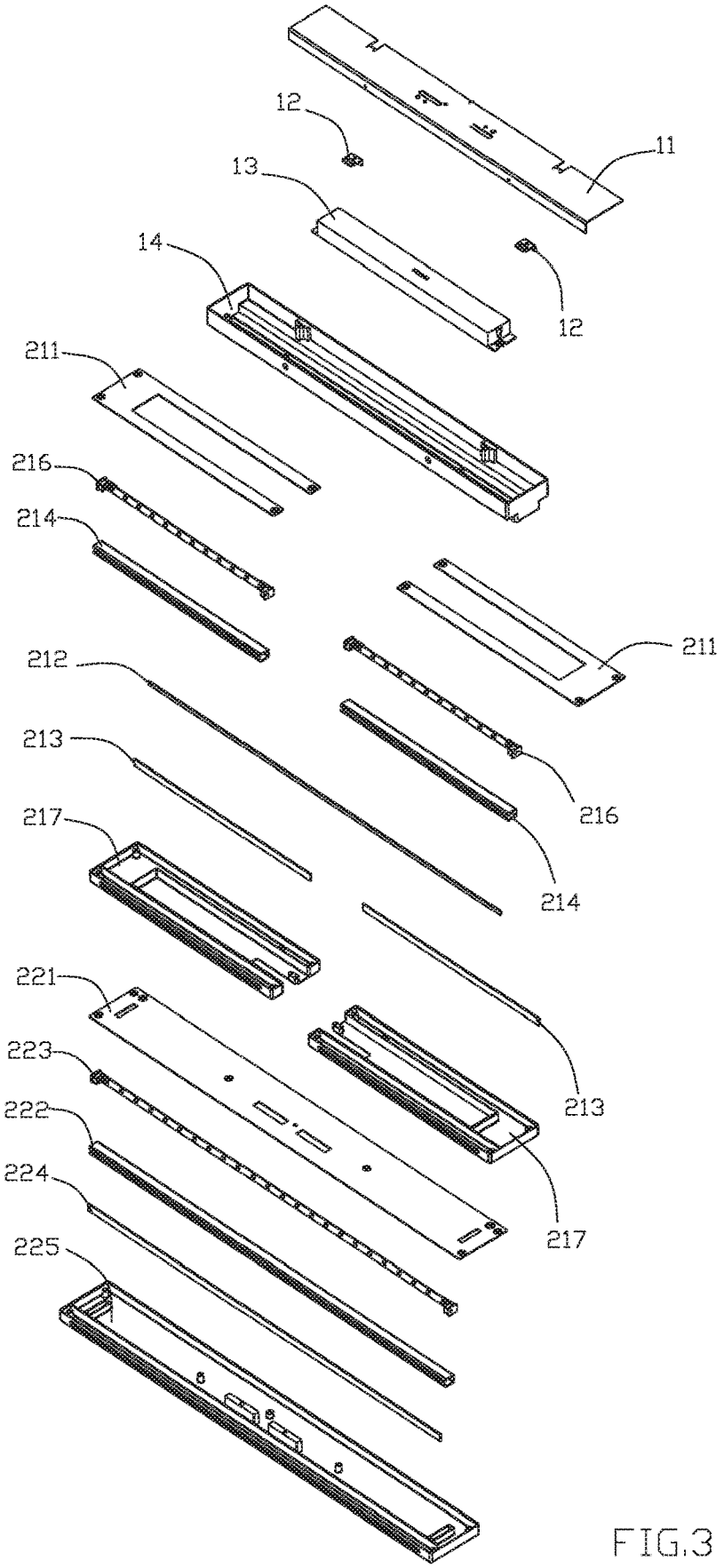

FIG. 3 is an exploded perspective view of the LED lamp in accordance with the preferred embodiment of the present invention.

Figure 4:
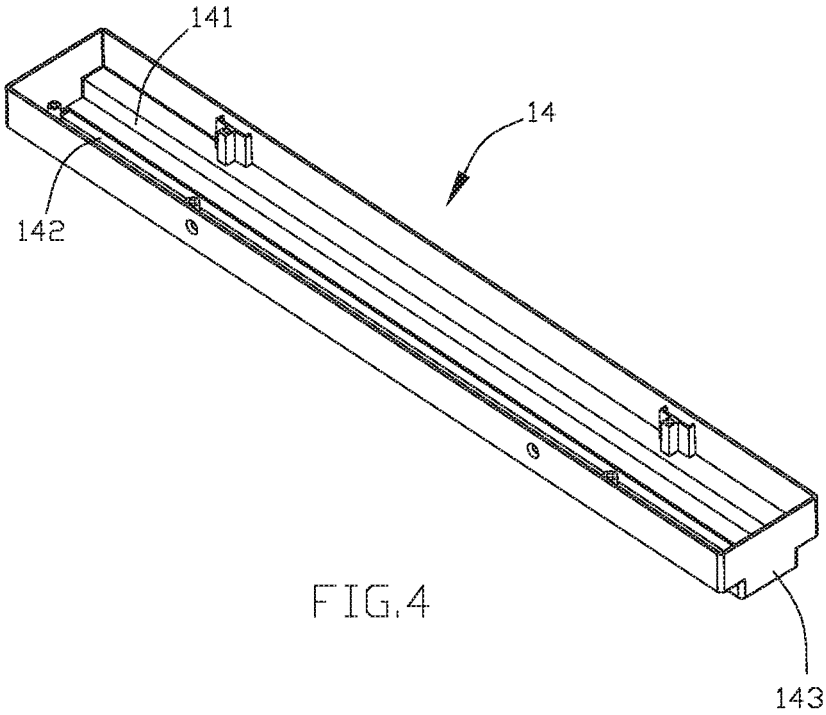

FIG. 4 is a perspective view of a wall seat of the LED lamp in accordance with the preferred embodiment of the present invention.

Figure 5:
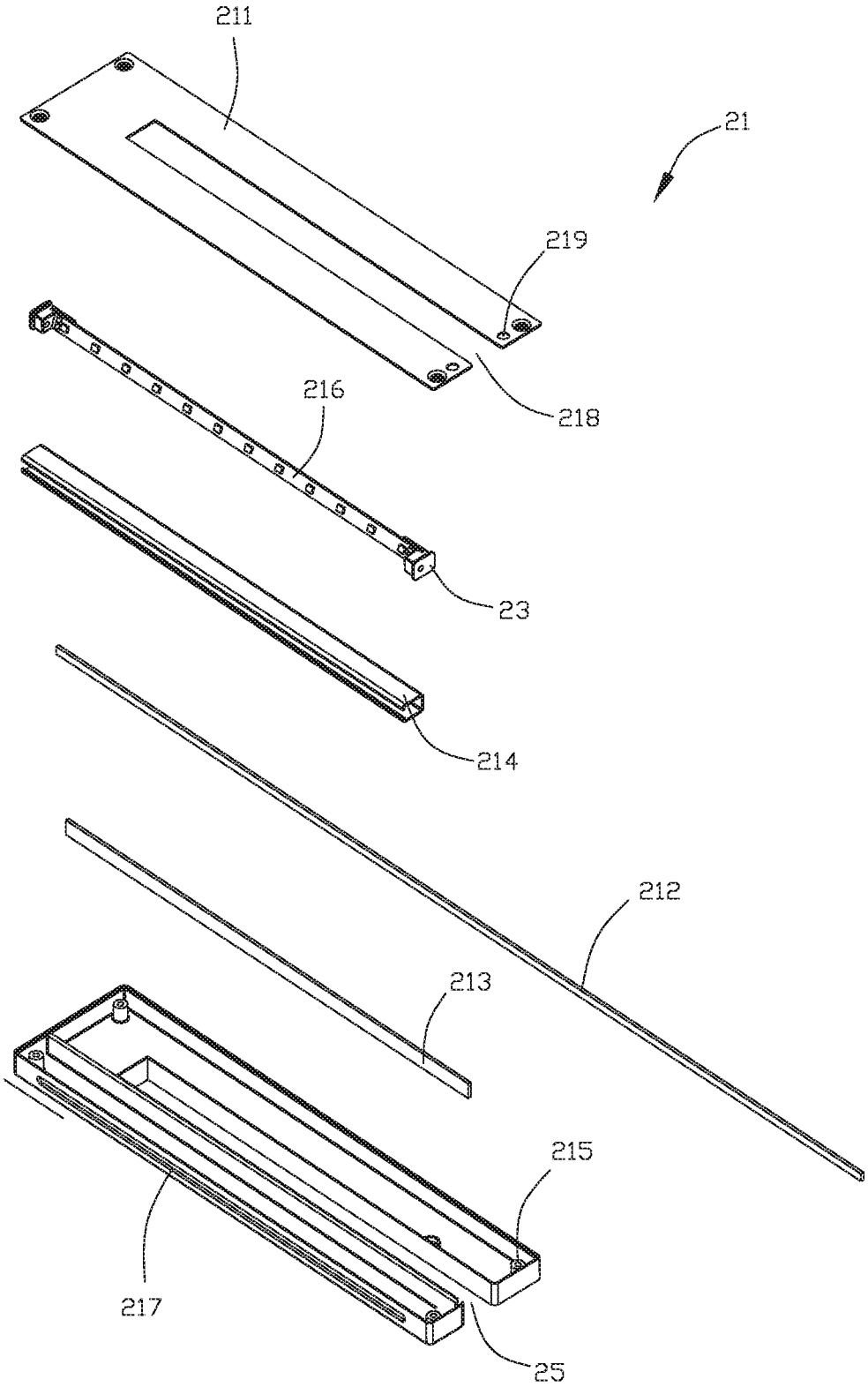

FIG. 5 is an exploded perspective view of a first lighting unit of the LED lamp in accordance with the preferred embodiment of the present invention.

Figure 6:
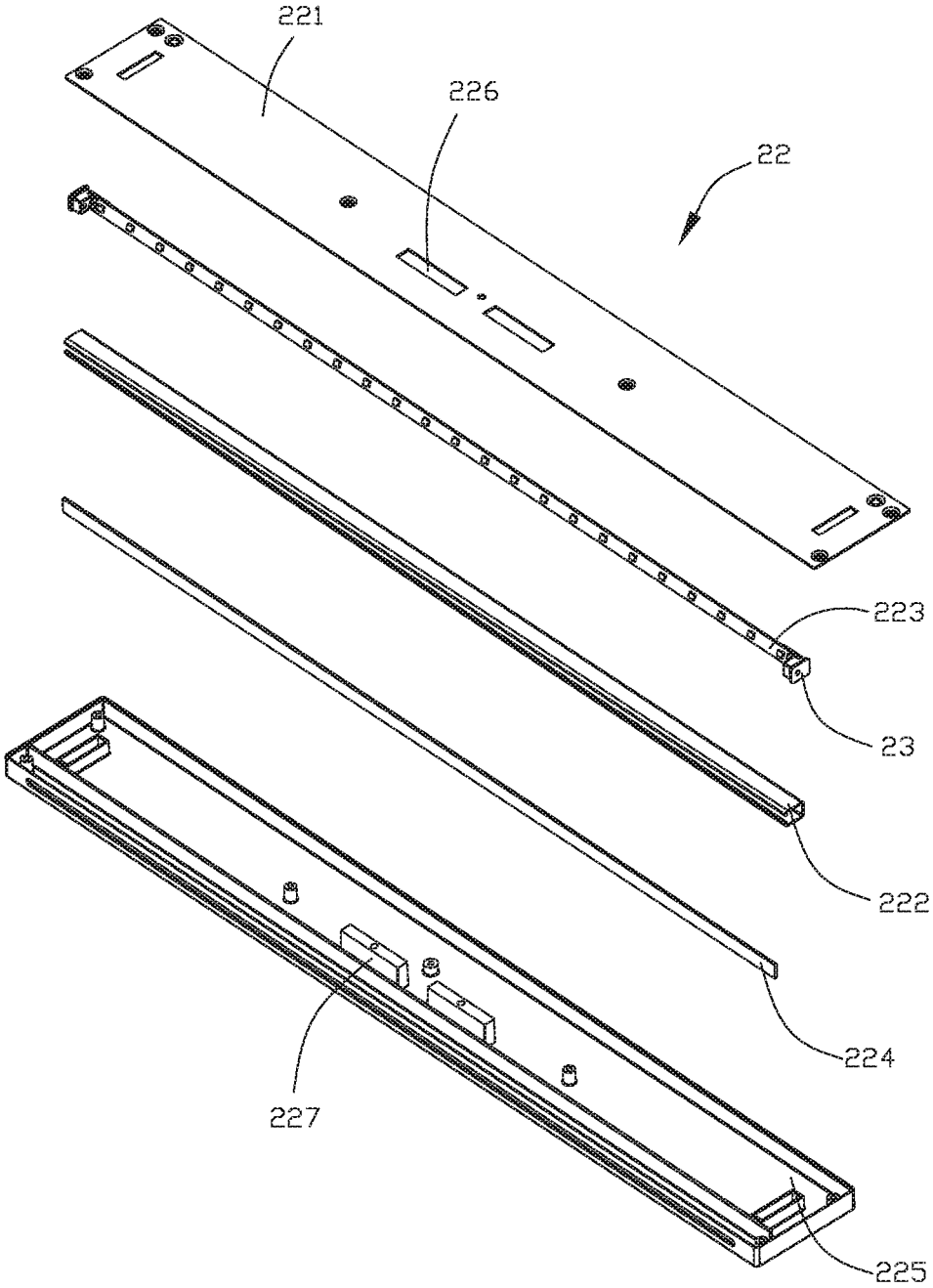

FIG. 6 is an exploded perspective view of a second lighting unit of the LED lamp in accordance with the preferred embodiment of the present invention.

DETAILED DESCRIPTION OF THE INVENTION

Referring to FIGS. 1-6, an LED lamp in accordance with the preferred embodiment of the present invention is mounted on a wall or a ceiling, and comprises a mounting mechanism 10, and an illuminating apparatus 20 mounted on the mounting mechanism 10.

The mounting mechanism 10 includes a wall seat 14 provided with a receiving chamber 141, and a wall plate 11 mounted on the wall seat 14 and covering the receiving chamber 141 of the wall seat 14. The receiving chamber 141 of the wall seat 14 has a bottom provided with a slideway 142 and a protruding rib 143. The slideway 142 penetrates the wall seat 14, and the protruding rib 143 extends through a whole length of the wall seat 14.

The illuminating apparatus 20 includes two first lighting units 21 mounted on a bottom of the mounting mechanism 10 respectively, and a second lighting unit 22 mounted on a bottom of the two first lighting unit 21. The second lighting unit 22 is located under the two first lighting unit 21. The second lighting unit 22 extends through the two first lighting unit 21 and is connected with the mounting mechanism 10. The two first lighting units 21 slide on the bottom of the mounting mechanism 10. Each of the two first lighting units 21 includes a first bottom plate 217, a first cover 211 covering the first bottom plate 217, a first receiving space defined between the first bottom plate 217 and the first cover 211, and at least one connecting member 215 mounted in the first receiving space. The first cover 211 is provided with a mounting slot 218 slidably mounted on the protruding rib 143 of the wall seat 14, such that the first cover 211 is slidably mounted on the wall seat 14, and each of the two first lighting units 21 of the illuminating apparatus 20 is slidably mounted on the mounting mechanism 10. Each of the two first lighting units 21 of the illuminating apparatus 20 is connected with the mounting mechanism 10 by engagement between the mounting slot 218 and the protruding rib 143. The first cover 211 is provided with at least one mounting hole 219, and the at least one connecting member 215 extends through the at least one mounting hole 219 and is slidably mounted in the slideway 142 of the wall seat 14. Thus, the two first lighting units 21 are slidable on the bottom of the mounting mechanism 10.

In the preferred embodiment of the present invention, the mounting mechanism 10 further includes two locking members 12 mounted on the wall plate 11, and a power supply 13 mounted in the receiving chamber 141 of the wall seat 14. The two locking members 12 attach the LED lamp to the wall or the ceiling. The power supply 13 of the mounting mechanism 10 is electrically connected with each of the two first lighting units 21 and the second lighting unit 22 to provide an electric power to each of the two first lighting units 21 and the second lighting unit 22.

In the preferred embodiment of the present invention, each of the two first lighting units 21 further includes a copper strip 212, a first light permeation piece 213, a first light tube 214, and a first light emitting module 216 each of which is mounted in the first receiving space. When the two first lighting units 21 slide on the bottom of the mounting mechanism 10, the two first lighting units 21 are kept at a steady state by the copper strip 212.

In the preferred embodiment of the present invention, the first light tube 214 is provided with a first fitting groove. The first light emitting module 216 is mounted in the first fitting groove of the first light tube 214. The first light emitting module 216 has two ends each provided with a silicone plug 23 inserted into the first fitting groove of the first light tube 214, such that the first light emitting module 216 is mounted in the first fitting groove of the first light tube 214 steadily and solidly, to prevent the first light emitting module 216 from being damaged when the first light tube 214 is deformed. The first light permeation piece 213 is mounted in the first fitting groove of the first light tube 214 and closes an opening of the first fitting groove.

In the preferred embodiment of the present invention, the first bottom plate 217 of each of the two first lighting units 21 is provided with an open channel 25 slidably mounted on the protruding rib 143 of the wall seat 14, such that the first bottom plate 217 is slidably mounted on the wall seat 14.

In the preferred embodiment of the present invention, the second lighting unit 22 includes a second cover 221, a second light tube 222, a second light emitting module 223, a second light permeation piece 224, and a second bottom plate 225. The second cover 221 covers the second bottom plate 225, and a second receiving space is defined between the second cover 221 and the second bottom plate 225. The second light tube 222, the second light emitting module 223, and the second light permeation piece 224 are mounted in the second receiving space.

In the preferred embodiment of the present invention, the second light tube 222 is provided with a second fitting groove. The second light emitting module 223 is mounted in the second fitting groove of the second light tube 222. The second light emitting module 223 has two ends each provided with a silicone plug 23 inserted into the second fitting groove of the second light tube 222, such that the second light emitting module 223 is mounted in the second fitting groove of the second light tube 222 steadily and solidly, to prevent the second light emitting module 223 from being damaged when the second light tube 222 is deformed. The second light permeation piece 224 is mounted in the second fitting groove of the second light tube 222 and closes an opening of the second fitting groove.

In the preferred embodiment of the present invention, the second cover 221 is provided with a plurality of through holes 226, and the second bottom plate 225 is provided with a plurality of projections 227 which in turn extend through the through holes 226 of the second cover 221, the open channel 25 of the first bottom plate 217, and the mounting slot 218 of the first cover 211, and are secured to the protruding rib 143 of the wall seat 14.

Accordingly, the two first lighting units 21 are slidable on the bottom of the mounting mechanism 10, such that the LED lamp is extendable to regulate the lighting range according to requirements of the practical environment or situation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An LED lamp comprising:

a mounting mechanism; and an illuminating apparatus mounted on the mounting mechanism;

wherein:

the mounting mechanism includes a wall seat provided with a receiving chamber, and a wall plate mounted on the wall seat and covering the receiving chamber of the wall seat;

the receiving chamber of the wall seat has a bottom provided with a slideway and a protruding rib;

the illuminating apparatus includes two first lighting units mounted on a bottom of the mounting mechanism respectively, and a second lighting unit mounted on a bottom of the two first lighting unit;

the second lighting unit extends through the two first lighting unit and is connected with the mounting mechanism;

each of the two first lighting units includes a first bottom plate, a first cover covering the first bottom plate, a first receiving space defined between the first bottom plate and the first cover, and at least one connecting member mounted in the first receiving space;

the first cover is provided with a mounting slot slidably mounted on the protruding rib of the wall seat;

each of the two first lighting units of the illuminating apparatus is connected with the mounting mechanism by engagement between the mounting slot and the protruding rib;

the first cover is provided with at least one mounting hole; and the at least one connecting member extends through the at least one mounting hole and is slidably mounted in the slideway of the wall seat.

2. The LED lamp of claim 1, wherein the mounting mechanism further includes two locking members mounted on the wall plate, and a power supply mounted in the receiving chamber of the wall seat, and the power supply of the mounting mechanism is electrically connected with each of the two first lighting units and the second lighting unit.

3. The LED lamp of claim 1, wherein each of the two first lighting units further includes a copper strip, a first light permeation piece, a first light tube, and a first light emitting module each of which is mounted in the first receiving space.

4. The LED lamp of claim 3, wherein:

the first light tube is provided with a first fitting groove;

the first light emitting module is mounted in the first fitting groove of the first light tube;

the first light emitting module has two ends each provided with a silicone plug inserted into the first fitting groove of the first light tube; and the first light permeation piece is mounted in the first fitting groove of the first light tube and closes an opening of the first fitting groove.

5. The LED lamp of claim 1, wherein the first bottom plate of each of the two first lighting units is provided with an open channel slidably mounted on the protruding rib of the wall seat.

6. The LED lamp of claim 4, wherein:

the second lighting unit includes a second cover, a second light tube, a second light emitting module, a second light permeation piece, and a second bottom plate;

the second cover covers the second bottom plate;

a second receiving space is defined between the second cover and the second bottom plate; and the second light tube, the second light emitting module, and the second light permeation piece are mounted in the second receiving space.

7. The LED lamp of claim 6, wherein:

the second light tube is provided with a second fitting groove;

the second light emitting module is mounted in the second fitting groove of the second light tube;

the second light emitting module has two ends each provided with a silicone plug inserted into the second fitting groove of the second light tube; and the second light permeation piece is mounted in the second fitting groove of the second light tube and closes an opening of the second fitting groove.

8. The LED lamp of claim 5, wherein:

the second cover is provided with a plurality of through holes;

the second bottom plate is provided with a plurality of projections; and the projections in turn extend through the through holes of the second cover, the open channel of the first bottom plate, and the mounting slot of the first cover, and are secured to the protruding rib of the wall seat.

* * * * *